US008407986B2

(12) United States Patent
Hahn

(10) Patent No.: US 8,407,986 B2
(45) Date of Patent: Apr. 2, 2013

(54) METHOD FOR OPERATING A LAMBDA SENSOR DURING THE HEATING PHASE

(75) Inventor: Hermann Hahn, Hanover (DE)

(73) Assignee: Volkswagen AG, Wolfsburg (DE)

( * ) Notice: Subject to any disclaimer, the term of this patent is extended or adjusted under 35 U.S.C. 154(b) by 344 days.

(21) Appl. No.: 12/920,219

(22) PCT Filed: Mar. 5, 2009

(86) PCT No.: PCT/EP2009/052589

§ 371 (c)(1),
(2), (4) Date: Nov. 3, 2010

(87) PCT Pub. No.: WO2009/109617

PCT Pub. Date: Sep. 11, 2009

(65) Prior Publication Data

US 2011/0036069 A1 Feb. 17, 2011

(30) Foreign Application Priority Data

Mar. 7, 2008 (DE) ..... 10 2008 013 515

(51) Int. Cl.
*F01N 3/00* (2006.01)

(52) U.S. Cl. ..... 60/286; 60/274; 60/277; 60/299; 73/23.32

(58) Field of Classification Search ..... 60/274–324; 73/114.69–114.76, 23.31, 23.32
See application file for complete search history.

(56) References Cited

U.S. PATENT DOCUMENTS

| | | | | |
|---|---|---|---|---|
| 7,104,110 | B2 * | 9/2006 | Oishi et al. | 73/1.06 |
| 2003/0019865 | A1 * | 1/2003 | Whitney et al. | 219/497 |
| 2005/0205550 | A1 | 9/2005 | Saito et al. | 219/497 |
| 2006/0047468 | A1 * | 3/2006 | Aoki | 702/132 |
| 2007/0007134 | A1 * | 1/2007 | Kawase et al. | 204/406 |
| 2007/0204840 | A1 * | 9/2007 | Abe | 123/697 |
| 2008/0307851 | A1 * | 12/2008 | Smith et al. | 73/1.06 |

FOREIGN PATENT DOCUMENTS

| | | | |
|---|---|---|---|
| DE | 43 00 530 | A1 | 7/1994 |
| DE | 10 2004 020 139 | A1 | 11/2005 |
| DE | 10 2005 006 760 | A1 | 8/2006 |
| EP | 1 832 735 | A2 | 9/2007 |
| JP | 2000074873 | A | 3/2000 |
| JP | 2001182586 | A | 7/2001 |
| JP | 2004-360526 | A | 12/2004 |
| JP | 2008138569 | A | 6/2008 |
| WO | 02/31355 | A1 | 4/2002 |

OTHER PUBLICATIONS

International PCT Search Report, PCT/EP2009/052589, 3 pages, Mailed Jul. 9, 2009.

* cited by examiner

*Primary Examiner* — Thomas Denion
*Assistant Examiner* — Jesse Bogue
(74) *Attorney, Agent, or Firm* — King & Spalding L.L.P.

(57) ABSTRACT

In a method for operating a lambda sensor disposed in an exhaust gas system of an internal combustion engine,—the heating element is subjected to a predefined heating power substantially with the start of the engine;—during the heating process, the sensor signal is detected and compared to a threshold value specified for a lean and/or rich fuel/air mixture ratio, wherein the threshold value correlates with a sensor temperature, which is below the water ingestion critical temperature, and to a valid lambda signal,—when one of the specified threshold values is reached for the first time, a measured variable correlating with the sensor temperature is determined and the lambda signal is set as valid and forwarded, and—the determined measured variable correlating with the sensor temperature is transferred to a closed heating element control loop as a target value that corresponds to a target temperature.

20 Claims, 1 Drawing Sheet

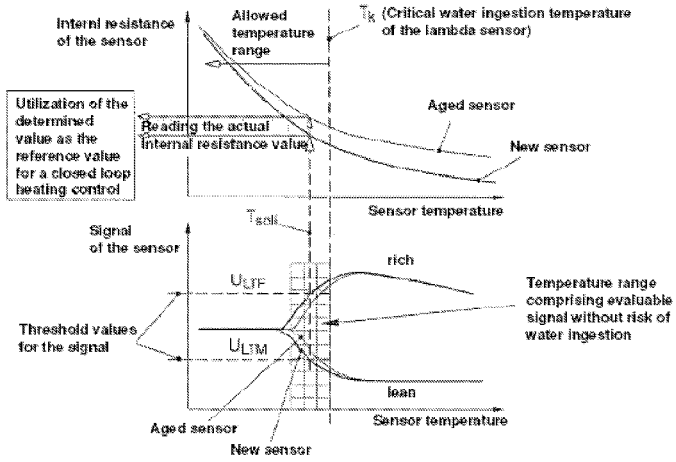

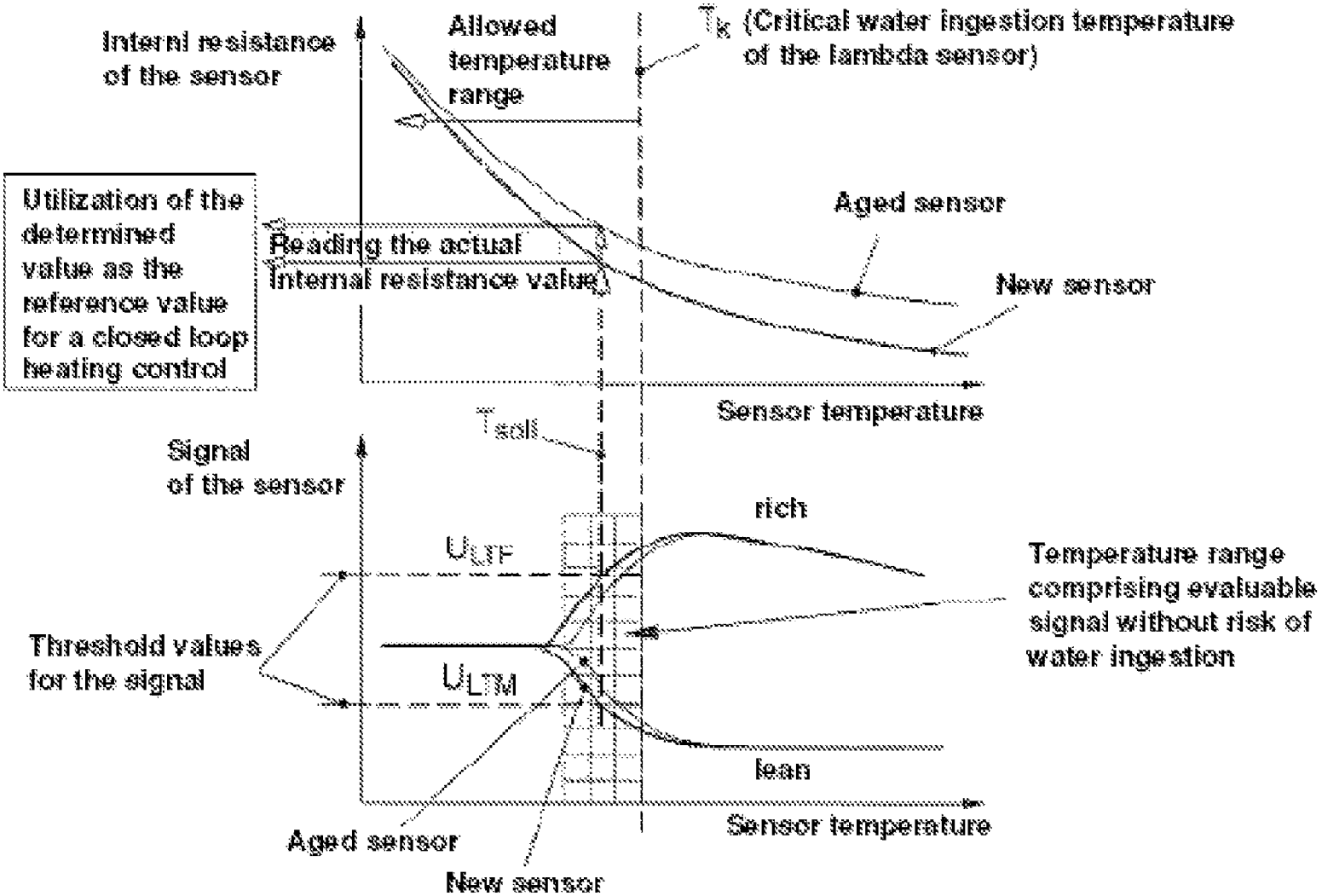
Internal resistance of the sensor
Allowed temperature range
$T_K$ (Critical water ingestion temperature of the lambda sensor)
Aged sensor
New sensor
Reading the actual internal resistance value
Utilization of the determined value as the reference value for a closed loop heating control
Sensor temperature
$T_{soll}$
Signal of the sensor
$U_{LTM}$
$U_{LTF}$
rich
lean
Threshold values for the signal
Temperature range comprising evaluable signal without risk of water ingestion
Sensor temperature
Aged sensor
New sensor

METHOD FOR OPERATING A LAMBDA SENSOR DURING THE HEATING PHASE

CROSS-REFERENCE TO RELATED APPLICATIONS

This application is a U.S. National Stage Application of International Application No. PCT/EP2009/052589 filed Mar. 5, 2009, which designates the United States of America, and claims priority to German Application No. 10 2008 013 515.1 filed Mar. 7, 2008, the contents of which are hereby incorporated by reference in their entirety.

TECHNICAL FIELD

The invention relates to a method for operating a lambda sensor disposed in the exhaust gas system of an internal combustion engine during a heating phase, a vehicle comprising a control device arranged for performing the method and a program means for performing the method.

BACKGROUND

It is well-known that in order to conform to legal standards related to the allowed exhaust gas emissions of an internal combustion engine a high efficiency of exhaust gas purification methods is required. One of these methods is a preferably precise adjustment of the exhaust gas composition such that a catalytic converter disposed in the exhaust gas system preferably may operate effectively. In order to achieve a high conversion efficiency in today's three way catalytic converters these are charged with exhaust gas which alternatingly has a slight fuel surplus (rich) or a slight oxygen surplus (lean). According to prior art this so called lambda modulation is controlled by the measurement signal of a lambda sensor installed upstream of the catalytic converter. For the purpose of monitoring, installed downstream of the catalytic converter frequently is a second lambda sensor, whose measurement signal provides information about the achieved efficiency of the controlled exhaust gas system and for example allows for a closed loop system. It may be assumed that this downstream monitoring lambda sensor is aging less intense or fast due to the position more distant from the engine, and overall and as seen across the product life supplies a considerably more precise measurement signal due to the exhaust gas composition already reacted downstream of the catalytic converter. Therefore, the rearmost lambda sensor is used for correcting the forward lambda control and/or for adapting signal deviations of the upstream lambda sensor.

Today's lambda sensors are based on the operating principle that ceramics become conductive for oxygen at high temperatures. Therefore, the known lambda sensors for example have a ceramic body on which electrodes for determining a voltage or pumping electricity are applied, as well as a heating element which heats the ceramic body to temperatures in the range of 600-800° C. However, if fluid water arrives at the hot ceramic body at these temperatures then there exists the risk of damaging the element as a result of the thermal stress arising thereby. For this reason, according to prior art it is typically awaited with the heating of the lambda sensors until assuredly no fluid water caused by condensation or stratification can be present anymore at the installation position of the lambda sensor. Applicable calculation functions typically are located in an engine control unit. The problem arising therefrom is that the lambda sensors can only be heated some time after an engine start and until then the engine only can be operated in an uncontrolled manner which results in a degradation of the exhaust gas emission. This is particularly critical for the rearmost lambda sensor because the more distant the installation position is from the engine the longer it takes until the required temperature is reached at which no fluid water is present anymore (so called dew point stop). It would therefore be desirable to be able, already at an early point in time during the cold operating phase of an internal combustion engine before achieving the dew point stop of the exhaust gas equipment, to provide to the exhaust gas control an evaluable signal of the lambda sensor.

DE 10 2006 011 722 B3 discloses a method for correcting the output signal of a broad band lambda sensor of an internal combustion engine. Within the scope of this method the influence of humidity on the lambda value determined by the broad band lambda sensor is identified and computationally eliminated by means of a compensation model. For this purpose a measured humidity is introduced in the calibration of the broad band lambda sensor during an overrun fuel cut-off of the internal combustion engine.

DE 10 2005 059 794 B3: After switching form a presetting of a rich fuel/air mixture ratio in a combustion chamber of a respective cylinder of an internal combustion engine to a presetting of a lean fuel/air mixture ratio it is detected for a thereupon arising plateau phase of a measurement signal of an exhaust gas sensor disposed in an catalytic exhaust gas converter and this time period is determined as to be the emplacement time period. After switching form a presetting of a lean fuel/air mixture ratio in the combustion chamber of the respective cylinder to a presetting of a rich fuel/air mixture ratio a thereupon arising plateau phase of the measurement signal is detected and the time period of the plateau phase is determined as the release time period. Depending on the accumulation time period and the depletion time period an assignment rule for assigning the measurement signal to a detected fuel/air mixture ratio is adapted. In order to calibrate the exhaust gas sensor the assignment rule is adapted depending on a plateau value of the measurement signal during the plateau phase.

The following patent documents related to the technological background of the present invention are known: DE 10 2006 011 722 B3, DE 103 60 775 A1, DE 198 61 198 B4, DE 43 04 966 A1, DE 199 37 016 A1, DE 10 2004 006 875 A1, DE 103 39 062 A1, DE 199 26 139 A1 and DE 10 2005 038 492 A1.

Known from DE 199 34 319 A1 is a gas measurement sensor which has a protective pipe for protecting the ceramic sensor element. A further inner pipe comprising openings for entrance and exit of the measurement gas and the exhaust gas, respectively, is meant to protect the ceramic sensor element against a direct contact with water.

According to DE 10 2004 020 139 A1 a lambda sensor for an internal combustion engine for measuring the fuel/air mixture ratio in the exhaust gas flow of the internal combustion engine comprising an oxygen sensor element is proposed in which the portion of the oxygen sensor element extending into the exhaust gas flow is encompassed by a protective element for collecting condensation water. The lambda sensor constructed such may be put into operation already before or instantaneously after the start of the internal combustion engine since the risk of cold condensation water impacting the hot oxygen sensor element and the damage of the lambda sensor associated therewith shall be eliminated.

Known from DE 10 2004 035 230 A1 is a method for operating a gas measurement sensor by means of which operating states of the internal combustion engine are determined. Upon existence of an operating state in which a low temperature is to be expected in the exhaust gas line, as for example at a cold-start, the sensor is adjusted to a low temperature or is turned off completely in order to counteract the risk of a thermal shock due to the reaction to water. The sensor therefore does not have an adjustment ability at the start of the internal combustion engine.

According to DE 10 2004 054 014 A1 a ceramic component, in particular a sensor element for a gas sensor, for determining a physical characteristic of a measurement gas, in particular the temperature or the concentration of a component of the gas in the exhaust gas of internal combustion engines is specified which has a, in particular laminated, ceramic body. For a significant improvement of the thermal shock behavior of the ceramic body, i.e. for obtaining a significantly lowered sensitivity with respect to the occurrence of strongly localized temperature gradients, which initiate crack formation in the ceramic body, at least the surface areas of the ceramic body which are exposed to large temperature gradients are coated by a protective coating which has at least two ceramic layers which form an intermediate boundary layer comprising a low fracture energy.

DE 10 2006 012 476 A1 discloses a method for operating a sensors, in particular a sensor comprised of a ceramic material, wherein the sensor is heated up to a shock resistance temperature which is greater than a specified operating temperature of the sensor. After also the vicinity of the sensor has been heated by the shock resistance temperature for some time the normal operating temperature is adjusted. It is further proposed to at first regulate a temperature lower than the normal operating temperature.

DE 10 2004 031 083 B3 discloses a method for heating lambda sensors in an exhaust gas system arranged downstream of the internal combustion engine of a vehicle comprising at least one catalytic converter equipment in the exhaust gas line of the exhaust gas system as well as comprising a sensor disposed upstream of and downstream of the catalytic converter, respectively, wherein in order to avoid a water ingestion risk for the sensors the heating of the sensors to their operating temperature is started at a heating time at which a predefined condensation formation temperature critical for the condensation formation in the region of the exhaust gas line is exceeded. At a cold-start of the internal combustion engine, starting at a predefined heating time, out of the two sensors at first only the downstream sensor is heated to a predefined sensor temperature. The sensor heated to this temperature, in the further course of the cold-start phase, for a time period until a condensation formation temperature critical to the condensation formation in the upstream region of the exhaust gas line is exceeded is operated by a control device as a control sensor by means of which the control of the lambda value is carried out to reach a predefined lambda value. Upon overstepping the critical condensation formation temperature in the pre-catalytic converter region of the exhaust gas line the upstream sensor is heated up to a predefined sensor temperature. The method disclosed necessarily uses one lambda sensor upstream of the catalytic converter and one lambda sensor downstream of the catalytic converter. This limits the use of the method to exhaust gas systems comprising two lambda sensors, whereby increased cost and an additional technical sensitivity have to be accepted.

SUMMARY

According to various embodiments, already at a preferably early point in time during a start and heating phase of an internal combustion engine comprising a lambda controlled exhaust gas system, in particular prior to reaching the end of the dew point, a reliable lambda control for controlling the fuel/air mixture ratio can be provided and this can be ensured in a particularly cost effective manner and throughout the lifetime of the exhaust gas system.

According to an embodiment, a method for operating at least one lambda sensor arranged in an exhaust gas system of an internal combustion engine during a start and heating phase comprising a lambda control system for controlling the fuel/air mixture ratio of a combustion process of the internal combustion engine, wherein the exhaust gas system has at least one catalytic converter and assigned to the lambda sensor is at least one electric heating element for heating up the lambda sensor to an operating temperature and the heating-up of the heating element is carried out by means of a heating element control, wherein control parameters are predetermined for the lambda control system, the method may comprise that: substantially synchronous with the start of the internal combustion engine the heating element is charged with a predefined heating power; during the heating a signal of the lambda sensor is detected and is compared to a predetermined threshold value for a lean and/or for a rich fuel/air mixture ratio which correlates with a temperature value of the lambda sensor which is below a water ingestion critical temperature and at the same time conforms to a valid lambda signal; at a first-time arrival of the lambda signal at one of the predetermined threshold values for a lean and/or for a rich fuel/air mixture ratio a determination of a measurement variable correlating with the temperature of the lambda sensor is triggered and the lambda signal, identified as valid, is forwarded for a further; and the determined measurement variable correlating with the temperature of the lambda sensor is transferred to a closed heating element control loop as a reference value corresponding to a reference temperature.

According to a further embodiment, the determination of the measurement variable correlating with the temperature of the lambda sensor can be accomplished by measuring the ohmic resistance of the heating element or of a electrode/electrodes of the lambda sensor or by means of detecting a signal of a temperature sensor. According to a further embodiment, the threshold value predetermined for a lean and/or for a rich fuel/air mixture ratio may correlate with a temperature value of the lambda sensor in a range of 150 to 500° C., preferably between 300 and 450° C. According to a further embodiment, the heating of the heating element during a first pre-definable time period of the start and heating phase may be accomplished by means of an open loop control, and by means of a closed loop control after the first time period has elapsed.

According to a further embodiment, after one of the predetermined threshold values of the lambda signal is reached a pre-definable period of time may be awaited before the lambda signal identified as valid is forwarded to a further utilization, wherein the period of time is predetermined in the form of a pre-definable time counter or a predetermined energy amount. According to a further embodiment, the determination of the measurement variable correlating with the temperature of the lambda sensor triggered by the first-time arrival of the lambda signal at one of the predetermined threshold values can be carried out by means of letting elapse a pre-definable period of time, wherein this period of time is predetermined in the form of a pre-definable time counter or a predetermined energy amount. According to a further embodiment, the method may be applied for operating a lambda sensor disposed upstream of and/or downstream of the catalytic converter with respect to the direction of exhaust gas flow. According to a further embodiment, for calculating the temperature at different locations within the exhaust gas system the heating element control may use a temperature model into which at least one detected temperature value is introduced. According to a further embodiment, during the start and heating phase the lambda control of the internal combustion engine by means of the lambda control system can be accomplished using adapted control parameters. According to a further embodiment, the lambda signal identified as valid can be provided to a diagnostic method for determining the ageing status of the catalytic converter. According to a further embodiment, the lambda signal identified as valid of a lambda sensor downstream of the catalytic converter can be provided to a diagnostic method for determining the ageing status of a lambda sensor upstream of the catalytic converter. According to a further embodiment, the lambda signal identified as valid can be supplied to the lambda control system for controlling the fuel/air mixture ratio of the internal combustion engine, in particular to end an operation of the internal combustion engine with rich fuel/air mixture ratio which was set following a phase with shut-off fuel feed. According to a further embodiment, the temperature reference value determined for the closed heating element control loop can be subjected to an additional adaptation depending on at least one additional parameter, wherein the at least one additional parameter correlates with at least one variable corresponding to the heating level of the entire exhaust gas system. According to a further embodiment, the variable corresponding to the heating level of the entire exhaust gas system may correlate with the exhaust gas temperature at the position of the lambda sensor.

According to another embodiment, a program means may stored or storable on a data medium may perform a method for operating at least one lambda sensor during a start and heating phase as defined above.

According to yet another embodiment, a vehicle may comprise an internal combustion engine, an exhaust gas system assigned to the internal combustion engine comprising at least one lambda sensor and a lambda control system for controlling the fuel/air mixture ratio of a combustion process of the internal combustion engine, wherein assigned to the lambda sensor is at least one electric heating element for heating-up the lambda sensor to an operating temperature and a heating element control for performing the heating-up of the heating element, wherein a control device which can be arranged for performing the method according as described above during a start and heating phase.

BRIEF DESCRIPTION OF THE DRAWINGS

In the following the invention is described in an exemplary embodiment by means of:

FIG. 1 which depicts the functional principle of the various embodiments using the example of a step lambda sensor (or Narrowband lambda sensor), i.e. a Nernst sensor.

DETAILED DESCRIPTION

According to various embodiments, in a method for operating at least one lambda sensor arranged in an exhaust gas system of an internal combustion engine, during a start and heating phase, a lambda control system controls the fuel/air mixture ratio of a combustion process of the internal combustion engine, wherein the exhaust gas system has at least one catalytic converter and associated to the lambda sensor is at least one electrical heating element for heating the lambda sensor up to an operating temperature and the heating of the heating element is carried out by a heating element control, wherein control parameters are forced for the lambda control system. The method according to various embodiments allows for that

- substantially synchronous to the start of the internal combustion engine a predefined heating power is applied to the heating element,
- throughout the heating a signal of the lambda sensor is detected and is compared to a threshold value ($U_{LTF}$, $U_{LTM}$), predefined for a lean and/or for a rich fuel/air mixture ratio, which correlates to a temperature value of the lambda sensor that is below a water ingestion critical temperature ($T_k$) and at the same time conforms to a valid lambda signal,
- upon a first-time arrival of the lambda signal at a threshold value ($U_{LTF}$, $U_{LTM}$) predefined for a lean and/or for a rich fuel/air mixture ratio a determination of a measurement variable correlating with the temperature of the lambda sensor is initiated and the lambda signal identified as valid is forwarded for a further utilization, and
- the determined measurement variable correlating with the temperature of the lambda sensor is transferred to a closed heating element control loop as a reference value corresponding to a reference temperature ($T_{soll}$).

According to various embodiments, during a water ingestion vulnerable starting phase of an internal combustion engine, the lambda sensor is heated with a low reference temperature below the water ingestion critical temperature, wherein the fact is utilized that the lambda sensor already supplies a utilizable lambda signal at this temperature. Particularly preferred, at the first-time arrival of the lambda signal at the at least one predefined threshold value (or after a certain predefined duration after the arrival at the threshold value has elapsed) the temperature of the lambda sensor is determined and buffered as a limiting temperature reference value for the heating element control. Then, in a preferably closed loop control, the heating element control controls the temperature of the lambda sensor to this temperature such that when, for example, the lambda sensor temperature falls below the reference temperature the heating element control controls the heating element such that it again heats the sensor to this determined reference value, but not higher, as long as the water ingestion critical phase has not elapsed definitely. The lambda signal is utilizable already at this early point in time and may therefore be provided for further intended purposes in the field of an internal combustion engine as described below. Thereby, as well-understood by a person skilled in the art, the term "water ingestion critical temperature" is to mean a temperature of the lambda sensor (in more detail: temperature of the ceramic element of the sensor) at which and above which a risk for destructing the ceramic element due to the accumulation of water condensate, i.e. of fluid water, and due to thermal stresses in the ceramic body of the sensor arising therefrom exists. The water ingestion critical temperature is a parameter specific to material and design and therefore may not be provided in a generic manner. As a general rule, it is specified by the manufacturer of the lambda sensor or may be determined by appropriate series of measurements.

Various embodiments emanate from a method for operating at least one lambda sensor in the exhaust gas system of an internal combustion engine comprising a lambda control system for controlling the fuel/air mixture ratio of a combustion process of the internal combustion engine during a start and heating phase. The exhaust gas system has a catalytic converter, and at least one electrical heating element for heating the lambda sensor up to an operating temperature which is heated in at least one method step. The heating-up of this heating element is carried out by a heating element control, wherein control parameters are forced for the lambda control system.

The method provides for that initiated by the start of the internal combustion engine, substantially synchronous the heating element in a first process regulation is charged with a first predefined heating power;

in a second process directive the signal of the lambda sensor is detected;

in a third process directive the detected lambda signal is compared to each a threshold value ($U_{LTF}$, $U_{LTM}$) predefined for a lean and a rich fuel/air mixture ratio which is correlated with a temperature value of the lambda sensor which is below the water ingestion critical temperature and at the same time conforms to a valid lambda signal;

in a fourth process directive a determination of a measurement variable correlated with the temperature of the lambda sensor is triggered by a first-time arrival of the lambda signal at one of the predefined threshold values ($U_{LTF}$, $U_{LTM}$) and the lambda signal, identified as valid, is forwarded to a further utilization;

and the determined measurement variable, correlating with the temperature of the lambda sensor, is transferred to a closed heating element control loop as a temperature reference value.

According to a further embodiment of the method the determination of a measurement variable correlating with the temperature of the lambda sensor is carried out by measuring the ohmic resistance of the heating element or the electrode/s of the lambda sensor or by detecting a signal of a temperature sensor disposed in the vicinity of the lambda sensor. In particular it is determined at which resistance value $R_I$ or $R_H$ of the lambda sensor or of the heating element during heating of the sensor the sensor signal for the first time exceeds or falls below predefined threshold values $U_{LTF}$ or $U_{LTM}$ which correspond to a signal in the range of rich (F) and lean (M) mixture composition, respectively.

According to various embodiments, two threshold values are given for the lambda signal, each correlating with a water ingestion uncritical temperature, wherein one of the threshold values corresponds to the lambda signal in a lean fuel/air mixture ratio and the other threshold value corresponds to the lambda signal in a rich fuel/air mixture ratio. Depending on whether the internal combustion engine presently is operated lean or rich, i.e. if a lean or a rich exhaust gas is reaching the sensor, always only one of the two threshold values may be reached by the sensor signal.

In an embodiment the threshold value $U_{LTF}$ and $U_{LTM}$, respectively, predefined for a lean and/or for a rich fuel/air mixture ratio, each correlates with a water ingestion uncritical temperature value of the lambda sensor in the range of 150 to 450° C., preferably between 300 and 450° C. In other words, the water ingestion uncritical temperature reference value is predetermined in this temperature range.

This temperature value depends on the type of the lambda sensor used, for example a ceramic element such as titanium dioxide ceramics in the case of a broad band lambda sensor and a zirconium dioxide ceramics in the case of a Nernst lambda sensor.

According to yet a further embodiment the heating of the heating element is carried out by means of an open control loop during a first pre-definable time period of the start and heating phase and is carried out by means of a closed control loop after the expiration of this first time period of the start and heating phase.

In a further embodiment of the method the temperature value determined and the measurement variable correlating with the temperature value, respectively, is used as an actual value for the heating element control and at least temporarily the temperature reference value is set to equal this measured actual value. For this reason it is insignificant which is the absolute value of the determined resistance value. Variances of the resistance or alterations due to ageing of the sensor therefore do not result in a displacement of the temperature level, in contrary to methods which use a fixedly predefined resistance value. Also considering the variance of the resistance values a temperature range between for example 300 and 400° C., for example, may be encompassed as a water ingestion uncritical temperature reference value. In an alternative embodiment, after one of the predefined threshold values of the lambda signal is reached, a pre-definable period of time is awaited before the lambda signal identified as valid is forwarded to a further utilization, wherein the period of time is given in the form of a pre-definable time counter or a predefined amount of energy.

According to a further embodiment of the method the determination of a measurement variable correlating with the temperature of the lambda sensor to be carried out at a first-time arrival of the lambda signal at one of the predefined threshold values ($U_{LTF}$, $U_{LTM}$) only is triggered after the elapse of a pre-definable period of time, wherein this period of time as well is given in the form of a pre-definable time counter or a predefined amount of energy.

The method according to various embodiments may be applied to a lambda sensor disposed upstream and/or downstream of the catalytic converter with respect to the direction of the exhaust gas flow.

In an embodiment the heating element control utilizes a temperature model for calculating (actual) temperature conditions at different positions within the exhaust gas system into which at least one detected temperature value is introduced. Throughout the start and heating phase the lambda control is preferably carried out by means of the lambda control system using aligned control parameters.

In an embodiment the lambda signal identified as valid may be provided to a diagnostic method for determining the ageing status of the catalytic converters.

Further, in an embodiment the signal of a lambda sensor downstream of the catalytic converter and identified as valid may be provided to a diagnostic method for determining the ageing status of a lambda sensor upstream of the catalytic converter.

According to a further embodiment the signal of a lambda sensor operated according to various embodiments and identified as valid is supplied to the lambda control system for controlling the fuel/air mixture ratio fed into the internal combustion engine. In particular, the signal may be used in this connection to stop an operation of the internal combustion engine with rich fuel/air mixture which was set following a phase with disabled fuel feed (overrun fuel cut-off).

The temperature reference value determined for the closed heating element control loop, in a further embodiment of the method according to various embodiments, is subjected to an alignment depending on at least one additional parameter, wherein this additional parameter correlates with at least one parameter corresponding to the heating level of the overall exhaust gas system. According to a further embodiment of the method according to the various embodiments the parameter corresponding to the heating level preferably correlates with the exhaust gas temperature at the position of the lambda sensor. By means of these additional procedures the effect of the increasing heating of the sensor element on the heating resistance may be compensated for.

According to further embodiments, program means stored or storable on a data medium may perform the method according to various embodiments for operating at least one lambda sensor during a start and heating phase. According to further embodiments, a vehicle may comprise an internal combustion engine, an exhaust gas system assigned thereto comprising at least one lambda sensor and one lambda control system for controlling the fuel/air mixture ratio of a combustion process of the internal combustion engine during a start and heating phase. Thereby, as already mentioned, assigned to the lambda sensor is at least one electric heating element for heating the lambda sensor to an operating temperature which is heated up in at least one method step. The heating-up of this heating element is accomplished by means of a heating element control. According to various embodiments the vehicle has a control device arranged to carry out the method according to various embodiments. Thereby, the control device may be integrated into a conventional engine control unit and in particular may be carried out as a stored or storable program means for performing the method according to various embodiments.

The vehicle preferably may be a land craft, a water craft or an aircraft.

FIG. 1 in its lower part shows a typical behavior of a signal (for example a voltage U) of a new and an aged lambda sensor over increasing sensor temperature and time, respectively. Shown in the upper part of FIG. 1 are the behaviors of the internal resistance of the new and the aged lambda sensor, again depending on the sensor temperature.

At the time of start-up of the internal combustion engine and shortly thereafter the lambda sensor only has a minor temperature. Up to a certain lower temperature limit the sensor does not provide a signal and this signal remains at a constant value, respectively (FIG. 1, left region of the lower part). Subsequently, the sensor signal starts to increase with increasing temperature (in the case of a rich exhaust gas comprising $\lambda<1$) or to decrease (in the case of a lean exhaust gas comprising $\lambda>1$). According to various embodiments for the lean mixture ratio as well as for the rich mixture ratio each a threshold value $U_{LTM}$ and $U_{LTF}$, respectively, is now preset which corresponds to a certain sensor temperature which is below the water ingestion critical temperature $T_k$ (indicated by the dashed vertical line on the right). Aside from the criteria of water ingestion harmlessness the temperature corresponding to the threshold values also has to be in a temperature range in which a valid (utilizable) sensor signal is present, i.e. the sensor already has to respond. In other words, the temperature corresponding to the threshold values has to be above a light-off temperature of the sensor which in turn depends on the design of the sensor. This tolerable temperature range within which on the one hand a valid sensor signal (lambda signal) is present and at the same time a risk of water ingestion does not yet exist is depicted in the lower part of FIG. 1 highlighted in grey color. It is noticeable that the sensor signal of the new sensor arrives at the respective threshold value $U_{LTM}$ and $U_{LTF}$, respectively, somewhat earlier than the already aged sensor.

Upon reaching one of the two threshold values $U_{LTM}$ or $U_{LTF}$ an actual measurement variable of the lambda sensor is determined which correlates with the (water ingestion uncritical) sensor temperature. This preferably is the internal resistance of the sensor as indicated in the upper part of FIG. 1. This value is subsequently transferred to the heating element control as a reference value corresponding to a set point temperature. The heating element control then controls the heating element of the lambda sensor in a closed loop (closed loop control) such that the reference value of the internal resistance of the sensor is attuned, i.e. a difference between the actual resistance and the set point resistance is minimized. Therefore, the sensor temperature also is adjusted to the temperature correlating with the threshold values as reference temperature $T_{soll}$. In an alternative embodiment, after the sensor signal reaches one of the two threshold values $U_{LTM}$ or $U_{LTF}$, a predefined duration, which may be pre-determined as a time counter or as a predefined integral energy amount of the heating element control, may be awaited before the metering of the actual measurement variable of the lambda sensor (in particular its internal resistance) is carried out.

Simultaneously to reaching one of the two threshold values $U_{LTM}$ or $U_{LTF}$ the sensor signal is identified as valid and forwarded for further utilization. In particular it is used for the lambda control of the fuel/air mixture ratio supplied to the internal combustion engine.

By means of the solutions according to various embodiments a controlled operation of at least one lambda sensor may therefore be carried out at an earlier point in time during a start and heating phase as compared to prior art, whereby fuel is saved and the specified exhaust gas emission values are complied with earlier after a start of the internal combustion engine. At the same time it is ensured that the lambda sensor may not be destroyed by water deposition during the start and heating phase. In particular with the use of two-point lambda sensors, the Nernst lambda sensors, according to various embodiments advantages arise in that the detection of the pre-definable threshold values of the lambda signal may be accomplished in a favorable range of its characteristics and at a high resolution. A well outstanding advantage of the various embodiments consists in that by means of a determination based on a measurement as opposed to a presetting of a temperature set point value for each individual internal combustion engine the always existing variance deviations of the measurement parameters, conditional to manufacturing, atmospheric conditions and deterioration, of the devices used for measuring the temperature of the lambda sensor are of less consequence so that also the results of heating and of the early provision of the lambda signal already during a water ingestion vulnerable phase may be significantly more precise. Thereby, as a consequence, according to various embodiments, it can be more effectively implemented to save fuel and to preserve the environment.

The foregoing specifications of the various embodiments are only given by way of example and are not to be construed as limiting. The present teaching of the invention may easily be assigned to other applications. The description of the exemplary embodiment is intended for purposes of exemplification and not to limit the scope of the patent claims. Many alternatives, modifications and variants are apparent to an average professional without departing from the scope of the present invention which is defined in the following claims.

What is claimed is:

1. A method for operating at least one lambda sensor arranged in an exhaust gas system of an internal combustion engine during a start and heating phase comprising a lambda control system for controlling the fuel/air mixture ratio of a combustion process of the internal combustion engine, wherein the exhaust gas system has at least one catalytic converter and assigned to the lambda sensor is at least one electric heating element for heating up the lambda sensor to an operating temperature and the heating-up of the heating element is carried out by means of a heating element control, wherein control parameters are predetermined for the lambda control system, that the method comprising:

substantially synchronous with the start of the internal combustion engine, charging the heating element with a predefined heating power;

during the heating, detecting a signal of the lambda sensor and comparing the detected signal to a predetermined threshold value for at least one of a lean fuel/air mixture ratio and a rich fuel/air mixture ratio, which correlates with a temperature value of the lambda sensor which is below a water ingestion critical temperature and at the same time conforms to a valid lambda signal;

at a first-time arrival of the lambda signal at one of the predetermined threshold values, triggering a determination of a measurement variable correlating with the temperature of the lambda sensor and forwarding the lambda signal, identified as valid, for a further utilization; and transferring the determined measurement variable correlating with the temperature of the lambda sensor to a closed heating element control loop as a reference value corresponding to a reference temperature.

2. The method according to claim 1, wherein the determination of the measurement variable correlating with the temperature of the lambda sensor is accomplished by measuring the ohmic resistance of the heating element or of at least one electrode of the lambda sensor or by means of detecting a signal of a temperature sensor.

3. The method according to claim 1, wherein the threshold value predetermined for at least one of a lean and a rich fuel/air mixture ratio correlates with a temperature value of the lambda sensor in a range of 150 to 500° C. or between 300 and 450° C.

4. The method according to claim 1, wherein the heating of the heating element during a first pre-definable time period of the start and heating phase is accomplished by means of an open loop control, and by means of a closed loop control after the first time period has elapsed.

5. The method according to claim 1, wherein after one of the predetermined threshold values of the lambda signal is reached a pre-definable period of time is awaited before the lambda signal identified as valid is forwarded to a further utilization, wherein the period of time is predetermined in the form of a pre-definable time counter or a predetermined energy amount.

6. The method according to claim 1, wherein the determination of the measurement variable correlating with the temperature of the lambda sensor triggered by the first-time arrival of the lambda signal at one of the predetermined threshold values is carried out by means of letting elapse a pre-definable period of time, wherein this period of time is predetermined in the form of a pre-definable time counter or a predetermined energy amount.

7. The method according to claim 1, wherein the method is applied for operating a lambda sensor disposed at least one of upstream and downstream of the catalytic converter with respect to the direction of exhaust gas flow.

8. The method according to claim 1, wherein for calculating the temperature at different locations within the exhaust gas system the heating element control uses a temperature model into which at least one detected temperature value is introduced.

9. The method according to claim 1, wherein during the start and heating phase the lambda control of the internal combustion engine by means of the lambda control system is accomplished using adapted control parameters.

10. The method according to claim 1, wherein the lambda signal identified as valid is provided to a diagnostic method for determining the ageing status of the catalytic converter.

11. The method according to claim 1, wherein the lambda signal identified as valid of a lambda sensor downstream of the catalytic converter is provided to a diagnostic method for determining the ageing status of a lambda sensor upstream of the catalytic converter.

12. The method according to claim 1, wherein the lambda signal identified as valid is supplied to the lambda control system for controlling the fuel/air mixture ratio of the internal combustion engine.

13. The method according to claim 1, wherein the temperature reference value determined for the closed heating element control loop is subjected to an additional adaptation depending on at least one additional parameter, wherein the at least one additional parameter correlates with at least one variable corresponding to the heating level of the entire exhaust gas system.

14. The method according to claim 13, wherein the variable corresponding to the heating level of the entire exhaust gas system correlates with the exhaust gas temperature at the position of the lambda sensor.

15. The method according to claim 1, wherein the lambda signal identified as valid is supplied to the lambda control system for controlling the fuel/air mixture ratio of the internal combustion engine, wherein the control system is configured to end an operation of the internal combustion engine with rich fuel/air mixture ratio which was set following a phase with shut-off fuel feed.

16. A data storage medium storing instructions which when executed on a computer perform a method for operating at least one lambda sensor during a start and heating phase, comprising:

substantially, synchronous with the start of an internal combustion engine, charging a heating element with a predefined heating power;

during the heating, detecting a signal of the lambda sensor and comparing the detected signal to a predetermined threshold value for at least one of a lean fuel/air mixture ratio and a rich fuel/air mixture ratio, which correlates with a temperature value of the lambda sensor which is below a water ingestion critical temperature and at the same time conforms to a valid lambda signal;

at a first-time arrival of the lambda signal at one of the predetermined threshold values, triggering a determination of a measurement variable correlating with the temperature of the lambda sensor and forwarding the lambda signal, identified as valid, for a further utilization; and transferring the determined measurement variable correlating with the temperature of the lambda sensor to a closed heating element control loop as a reference value corresponding to a reference temperature.

17. A vehicle comprising an internal combustion engine, an exhaust gas system assigned to the internal combustion engine comprising at least one lambda sensor and a lambda control system for controlling the fuel/air mixture ratio of a combustion process of the internal combustion engine, wherein assigned to the lambda sensor is at least one electric heating element for heating-up the lambda sensor to an operating temperature and a heating element control for performing the heating-up of the heating element, and a control device which is configured:

to charge, substantially synchronous with the start of the internal combustion engine, the heating element with a predefined heating power;

to detect, during the heating, a signal of the lambda sensor and to compare the detected signal to a predetermined threshold value for at least one of a lean fuel/air mixture ratio and a rich fuel/air mixture ratio, which correlates with a temperature value of the lambda sensor which is below a water ingestion critical temperature and at the same time conforms to a valid lambda signal;

to trigger, at a first-time arrival of the lambda signal at one of the predetermined threshold values, a determination of a measurement variable correlating with the temperature of the lambda sensor and to forward the lambda signal, identified as valid, for a further utilization; and to transfer the determined measurement variable correlating with the temperature of the lambda sensor to a closed heating element control loop as a reference value corresponding to a reference temperature.

18. The vehicle according to claim 17, wherein the control device is further configured to accomplish the determination of the measurement variable correlating with the temperature of the lambda sensor by measuring the ohmic resistance of the heating element or of at least one electrode of the lambda sensor or by means of detecting a signal of a temperature sensor.

19. The vehicle according to claim 17, wherein the threshold value predetermined for at least one of a lean and a rich fuel/air mixture ratio correlates with a temperature value of the lambda sensor in a range of 150 to 500° C. or between 300 and 450° C.

20. The vehicle according to claim 17, wherein the control device is further configured to accomplish the heating of the heating element during a first pre-definable time period of the start and heating phase by means of an open loop control, and by means of a closed loop control after the first time period has elapsed.

* * * * *